United States Patent [19]

Weyde et al.

[11] 4,413,055

[45] Nov. 1, 1983

[54] SILVER HALIDE EMULSION, A PHOTOGRAPHIC MATERIAL AND A PROCESS FOR THE PRODUCTION OF PHOTOGRAPHIC IMAGES

[75] Inventors: Edith Weyde, Kuerten; Harald von Rintelen, Leverkusen; Wilhelm Saleck, Bergisch Gladbach; Heinz-Horst Teitscheid, Leverkusen, all of Fed. Rep. of Germany

[73] Assignee: Agfa-Gevaert Aktiengesellschaft, Leverkusen, Fed. Rep. of Germany

[21] Appl. No.: 306,143

[22] Filed: Sep. 28, 1981

[30] Foreign Application Priority Data

Oct. 3, 1980 [DE] Fed. Rep. of Germany ..... 3037383

[51] Int. Cl.[3] ..... G03C 5/26; G03C 1/02

[52] U.S. Cl. ..... 430/567; 430/568; 430/569; 430/604; 430/608; 430/943

[58] Field of Search ..... 430/567, 569, 604, 608, 430/943, 290, 568

[56] References Cited

U.S. PATENT DOCUMENTS

| | | | |
|---|---|---|---|
| 3,185,571 | 5/1965 | Thiers et al. | 430/608 |
| 3,690,892 | 9/1972 | Fairbanks | 430/608 |
| 3,776,730 | 12/1973 | Matejec | 430/290 |
| 3,804,634 | 4/1974 | Shiba et al. | 96/125 |
| 3,864,134 | 2/1975 | Ueda et al. | 96/124 |
| 3,982,950 | 9/1976 | Shiba et al. | 430/567 |
| 4,065,312 | 12/1977 | Weyde et al. | 430/943 |
| 4,152,161 | 5/1979 | Idel et al. | 430/569 |
| 4,260,674 | 4/1981 | Weyde et al. | 430/943 |
| 4,269,927 | 5/1981 | Atwell | 430/569 |

FOREIGN PATENT DOCUMENTS

| | | |
|---|---|---|
| 644970 | 10/1950 | United Kingdom . |
| 2063499 | 6/1981 | United Kingdom . |

OTHER PUBLICATIONS

Chem. Absts., vol. 48, 2499g–h.

*Primary Examiner*—Mary F. Downey
*Attorney, Agent, or Firm*—Connolly and Hutz

[57] ABSTRACT

Silver halide emulsion with an average grain size of at most 0.6 μm containing Co-, Ce- or Cu-salts are suitable for the production of vesicular images.

9 Claims, No Drawings

SILVER HALIDE EMULSION, A PHOTOGRAPHIC MATERIAL AND A PROCESS FOR THE PRODUCTION OF PHOTOGRAPHIC IMAGES

This invention relates to a silver halide emulsion and to a photographic material which is particularly suitable for use in a process for the production of photographic images by the image-wise exposure of a layer containing a photosensitive silver salt and the decomposition of peroxide compounds on the image nuclei formed during exposure, the image being made visible either physically by development of the gas vesicles formed during decomposition or chemically by utilising the oxygen formed during decomposition for a dye-producing oxidation reaction. The present invention also relates to a process for the production of photographic images.

The production of photographic images by the image-wise formation of gas vesicles, is known. U.S. Pat. No. 3,615,491 describes a process for the production of photographic images consisting of a silver image and a vesicular image superimposed thereon.

In this process, a silver image is first conventionally produced in a hydrophilic layer, although it does show considerably less coverage than the conventional black-and-white images normally produced. The layer is then brought into contact with hydrogen peroxide, the hydrogen peroxide being decomposed to form small oxygen gas vesicles over those areas where the silver is present image-wise in finely divided form. When the exposed material is subsequently heated, the gas released expands and a vesicular image is formed. Since the vesicles obtained scatter the light image-wise, these areas appear dark in transmitted light, but light against a dark background when viewed in reflected light.

Most of the incident light is allowed through in the unexposed parts of the layer. In this way, the silver image is intensified to a very considerable extent, deep black images characterised by a high contrast in transmitted light being obtained, even where layers of very low silver content are used. The quality of the photographic images obtained by this process is excellent.

It is also known that the oxygen formed during the image-wise decomposition of hydrogen peroxide may be made visible chemically by using it for a dye-producing oxidation reaction rather than physically by vesicle formation as described above. In this process, a photosensitive layer is exposed with image-wise formation of nuclei of noble metals of the Ist and VIIIth Secondary Groups of the Periodic Table, after which this layer is treated with peroxy compounds which decompose catalytically on the nuclei formed image-wise in the presence of reaction components for a dye-producing oxidation reaction.

German Offenlegungsschrift No. 2,418,997 British Pat. No. 1,510,470 and U.S. Pat. Nos. 4,065,312 and 4,260,674 describe a photographic material for the dry production of photographic images by the image-wise exposure of a self-supporting or supported photosensitive layer containing dispersed photosensitive silver salts which, on exposure, form catalysts for the decomposition of peroxide compounds, and subsequent treatment of the exposed layer with a peroxide compound to form a visible image, the photosensitive layer containing the silver salt in quantities of from 1 to 500 mg/m$^2$, the silver salt dispersion having a pAg below the equivalent point before casting, the grain size of the silver salt grains being smaller than 0.3 μm and the transparency of the photographic material amounting to at least 80%. In this material, decomposition of the peroxide compounds is catalysed by much finer silver. The last of the above-described processes gives very sharp images with minimal graininess.

The disadvantage of these materials is the still relatively poor speed thereof. Accordingly, an object of the present invention is to provide a photographic material and a process distinguished by improved speed.

Accordingly the present invention relates to:

(1) A photosensitive silver halide emulsion having an average grain size of the silver halide grains of at most 0.6 μm, characterised in that it contains a at least one $Co^{2+}$, $Ce^{3+}$, $Ce^{4+}$, $Cu^{+}$ or $Cu^{2+}$-salt.

(2) A photosensitive photographic material containing at least one silver halide emulsion layer and, optionally, further layers, characterised in that it contains at least one silver halide emulsion according to (1).

(3) A process for the production of photographic images by the image-wise exposure of the material defined in (2), characterised in that, after exposure, the material is treated with a peroxide compound, optionally with the assistance of a heat treatment and/or development with a photographic developer, to form vesicles in image-wise distribution.

The cobalt, Ce, and copper salts mentioned are preferably sulphates, nitrates and chlorides. However, other salts are also suitable. If desired, complex salts of these metals may also be used. The salts are preferably present in the material in a quantity of from $10^{-1}$ to $10^{-8}$ moles per mole of silver salt, more preferably in a concentration of from $10^{-2}$ to $10^{-5}$ moles per mole of silver salt, or are used in this quantity during the formation of the silver salts. These salts are preferably present during formation of the silver salts.

The production of silver salts, particularly silver halides, in the presence of additional metal salts is known. Thus, it is pointed out in U.S. Pat. No. 2,910,359 that various salts and complexes of heavy metals may be added to photographic emulsions. Copper, cobalt and nickel salts are mentioned. However, it is not known to use salts of this type in the emulsions and materials according to the present invention on which peroxides are decomposed to form vesicles in image-wise distribution and of which the average grain size amounts to at most 0.6 μm.

Suitable photosensitive silver halides are, in particular, silver chloride, silver bromide or mixtures thereof, optionally containing silver iodide preferably in a quantity of up to 10%. Bromide emulsions containing up to 5 mole percent of silver iodide are especially suitable.

The average grain size of the silver halide grains in the photosensitive layers of the material according to the present invention is relatively small. It amounts to at most 0.6 μm, preferably to at most 0.1 μm. Silver salt dispersions having a relatively narrow grain size distribution with a maximum at about 0.05 μm are particularly favourable. In one preferred embodiment, at least 50% of the grains have an average diameter of at most 0.3μ.

The silver salts are preferably prepared in the presence of a suitable peptising agent. Suitable peptising agents are, for example, gelatin, particularly photographically inert gelatin, cellulose derivatives, such as cellulose esters or ethers, for example cellulose sulphate, carboxymethyl cellulose or cellulose acetates, particularly cellulose acetates having a degree of acetylation of up to 2, and synthetic polymers such as polyvinyl alcohols, partially hydrolysed polyvinyl esters, for example partially hydrolysed polyvinyl acetate, polyvinyl pyrrolidone.

Particularly suitable peptising agents are copolymers containing recurring 8-oxyquinoline units, the proportion of 8-oxyquinoline in the copolymer amounting to from 0.1 to 20%, by weight, preferably from 0.1 to 10%, by weight. Suitable comonomers are in particular water-soluble comonomers. In some cases, it may also be advantageous to incorporate other polymerisable monomers less readily soluble in water.

Copolymers obtained by polymerising 8-oxyquinoline-containing acrylic acid derivatives with acrylamide, acrylic acid and/or N-vinyl pyrrolidone have proved to be particularly suitable. Suitable copolymers are described, for example, in German Offenlegungsschrift No. 2,407,307.

The silver halide emulsions may be prepared by converting fine-grained silver phosphate. The silver phosphate to be converted preferably has a very fine grain, preferably an average grain size of from 0.05 to 0.3 $\mu$m. Silver phosphate as fine as this may be obtained for example, as follows:

(a) initially introducing silver nitrate into the gelatin solution in the precipitation vessel and briefly adding $Na_2HPO_4$ or (b) precipitating very fine-grained $MgHPO_4$ or cobalt phosphate which is converted with silver nitrate into silver phosphate, (c) initially introducing a gelatin-containing phosphoric acid solution, adding silver nitrate and precipitating the silver phosphate by rapidly increasing the pH, (d) adjusting the gelatin solution in the precipitation vessel to pH 2 and adding $Na_2HPO_4$ together with silver nitrate, fine-grained silver phosphate being precipitated by subsequently increasing the pH, (e) in two stages in accordance with German Pat. No. 1,472,745 and U.S. Pat. No. 3,790,386.

In the context of the present invention, "silver phosphates" are to be understood to be salts of silver with one of the acids of phosphorus in which the phosphorus atom is pentavalent. Silver phosphates of this type are known.

The silver halide emulsions may also be prepared in known manner by combining an aqueous solution of a halide and silver nitrate. This may be done, for example, by simultaneously running in the precipitation components. The concentration of silver ions may be relatively high, as in German Offenlegungsschrift No. 2,418,997, although it is also possible to work with relatively low concentrations of silver ions.

The silver halide dispersion may also be chemically sensitised, for example with reducing agents, such as tin(II) salts, polyamines, such as diethylene triamine, sulphur compounds, as described in U.S. Pat. No. 1,574,944 or in MEES' book entitled "Theory of the Photographic Process" (1954), pages 149 to 161. The described emulsions may also be chemically sensitised with salts of noble metals, such as ruthenium, rhodium, palladium, iridium, platinum or gold, as described in the Article by R. Koslowsky in Z.Wiss.Phot. 46(1951), pages 65 to 72. Other suitable chemical sensitisers are compounds from the thiomorpholine series, for example those described in French Pat. No. 1,506,230, or even polyalkylene oxides, particularly polyethylene oxide and derivatives thereof.

The silver halide dispersions may also be optically sensitised, for example with the conventional polymethine dyes, such as neutrocyanines, basic or acid carbocyanines, merocyamines or rhodacyanines, hemicyanines, styryl dyes, oxanols. Sensitisers of this type are described in F. M. Hamer's book entitled "The Cyanine Dyes and Relates Compounds" (1964).

Where hardenable binders are used for dispersing the silver salts, they may be hardened in the conventional way, for example with formaldehyde or with halogen substituted aldehydes containing a carboxyl group, such as mucombromic acid, diketones, methane sulphonic acid esters, dialdehydes. Instant hardening agents are particularly suitable.

To improve the stability in storage thereof, the emulsions according to the present invention may contain known oxidation inhibitors, such as alkali sulphite, bisulphite addition products of aldehydes and ketones, preferably cycloalkyl ketones, particularly cyclohexanone bisulphite.

To improve the stability of the image nuclei and photosensitivity, the materials according to the present invention may contain known compounds which are capable of acting as halogen acceptors, such as silver salts, reducing agents and developer substances. The latter also act as developer substances in the heat treatment of the exposed material and may be present in a photosensitive or non-photosensitive layer.

The positive effect of compounds of the type in question is attributable to the fact that the halogen formed in the primary reaction during exposure is intercepted. The destruction of the latent silver image nuclei by this halogen is thus prevented.

Suitable compounds are, for example, silver salts of the type described in German Offenlegungsschrift No. 2,418,997, pages 8 to 9.

A stabilising and hence photosensitivity-improving effect is shown by reducing agents, such as hydrazines and derivatives thereof, substituted hydrazines, acylated hydrazines, particularly hydrazides, also amino phenols, amino-substituted benzene compounds, particularly phenylene diamine, and substitution products thereof, for example the following: hydrazides, for example tartaric acid dihydrazide, malonic acid dihydrazide, malic acid dihydrazide, mucic acid dihydrazide, citric acid trihydrazide; polyamines, for example diethylene triamine; hydroxylamine derivatives, for example N-ethyl-N'-hydroxy urea, N-phenyl-N'-hydroxy urea, N-hydroxy urea, N-hydroxy benzamide, N-hydroxy carbamic acid ethyl ester; phenols, for example pyrocatechol, hydroquinone, 1,4-dihydroxy phthalimide, DL-d-methyl-$\beta$-(3,4-dihydroxyphenyl alanine), homogentisic acid, homogentisic acid amide, 2,5-dihydroxy phenyl-5-(1-phenyl tetrazolyl)-sulphide; phenylene diamines, for example N,N-diethyl-N'-sulphomethyl-p-phenylene diamine, N,N-dimethyl-N'-sulphomethyl-p-phenylene diamine, 3-methyl-4-sulphomethyl-amino-N,N-diethylene aniline; 3-pyrazolidones, for example 1-phenyl-3-pyrazolidone, 1-m-toluene-3-pyrazolidone, 1-p-toluyl-3-pyrazolidone, 1-phenyl-4-methyl-3-pyrazolidone, 1-phenyl-5-methyl-3-pyrazolidone, 1,4-dimethyl-3-pyrazolidone, 4-methyl-3-pyrazolidone, 4,4-dimethyl-3-pyrazolidone, 1-phenyl-2-acetyl-3-pyrazolidone, 1-phenyl-4,4-dimethyl-3-pyrazolidone, 1-(4-bromophenyl)-3-pyrazolidone, 1-p-toluyl-4-hydroxymethyl-4-methyl-3-pyrazolidone, 1-phenyl-4-hydroxymethyl-4-methyl-3-pyrazolidone.

The above compounds are added to the photographic layer before casting. The concentration thereof may vary within wide limits and depends upon the effectiveness of the compound and the purpose for which it is intended. In general, concentrations of from 10 to 500 mg per square meter of material have proved to be advantageous. Hydrazines and Hydrazides are particularly used in concentrations of 10 to 200 mg/m$^2$.

The photographic material may contain dye-producing compounds, for example the conventional colour couplers, which may be incorporated in the silver halide layers themselves. For examples of suitable colour couplers, see the Article entitled "Farbkuppler (Colour Couplers)" by W. PELZ in "Mitteilungen aus den Forschungslaboratorien der Agfa, Leverkusen/Munchen", Vol. III (1961) and K. VENKATARAMAN in "The Chemistry of Synthetic Dyes", Vol. 4, 341 to 387, Academic Press, 1971.

Other suitable couplers are 2-equivalent couplers, for example the known DIR couplers. The colour couplers may be added to the photosensitive silver halide emulsions or to other casting solutions by conventional methods.

Where the couplers are water-insoluble or alkali-insoluble compounds, they may be emulsified in known manner. So-called "coupler solvents" or oil-formers may have to be additionally used for incorporating hydrophobic compounds of the type in question by emulsification; cf. for example U.S. Pat. Nos. 2,322,027; 2,533,514; 3,689,271; 3,764,336 and 3,765,897.

The photographic materials may contain the conventional stabilisers, such as tri- or tetraazaindolizines, particularly those substituted by at least one hydroxyl and/or amino group. Indolizines of this type are described, for example, in the article by BIRR in Z.Wiss.Phot. 47 (1952), pages 2 to 58 and in U.S. Pat. No. 2,944,901. In addition benzotriazoles or heterocyclic mercapto compounds, for example 3-mercapto-4-amino-1,2,4-triazole, 3-mercapto-4-(p-sulphonic acid phenylamino)-5-methyl-1,2,4-triazole, may be used.

The photographic material may contain the substances which are normally used for improving the evolution of heat in thermal development processes and which give off water when heated, or hydrophilic compounds which increase the residual moisture of the layer. Compounds of the first type are, for example ureas, caprolactams, $\beta$-nitroethanols or $\beta$-cyanoethanols and salts which form defined hydrates, such as sodium acetate, sodium citrate or sodium sulphate.

Compounds of the second type are polyalcohols and mono- and oligo-saccharides. In addition to its effect as described in British Pat. No. 1,174,157, the latter compound is advantageously oxidised to acids by hydrogen peroxide during the thermal development step so that the pH of the processed layers is reduced. The frequently observed discolouration of the images in light is prevented by this reduction in the pH by the acids formed, for example saccharic acids.

In addition, the materials according to the present invention may contain the intermediate layers between the support and the emulsion layer which are described in German Pat. No. 1,189,383.

The transparency of the materials according to the present invention should preferably amount to at least 80%. This means that the material according to the present invention should absorb no more than 20% of visible light, the reference value being the transparency of a sheet-form material of the same structure and composition, but without any silver salts or other additions.

The photosensitive layers according to the present invention have a relatively low silver content (expressed as silver nitrate) of generally from 1 to 800 mg preferably from 200 to 400 mg per m$^2$, the thickness thereof generally amounting to from 0.5 to 15 $\mu$m, preferably from 2 to 10 $\mu$m.

The binders preferably used for the material according to the present invention are hydrophilic binders, for example natural binders, such as proteins, particularly gelatin, cellulose and derivatives thereof, such as cellulose esters or ethers, for example carboxymethyl cellulose or $\beta$-hydroxy ethyl cellulose, alginic acid and derivatives thereof, such as esters, salts or amides, starch or starch derivatives, carragenates.

The transparent layer supports known for photographic materials are suitable for the material according to the present invention. Such layer supports include, for example, films of cellulose esters, polyesters based on polyethylene terephthalic acid ester or polycarbonates, particularly polycarbonates based on bisphenol A. In selecting suitable layer supports, it is, of course, important to ensure that they are stable at the processing temperature.

Basically, the material according to the present invention may be used in any known processes for the production of photographic images by the image-wise decomposition of peroxide compounds. Such processes include processes in which the decomposition of a peroxide compound takes place on relatively coarse nuclei of metallic silver which are formed after exposure and photographic development. However, the material according to the present invention is particularly suitable for a process in which, following image-wise exposure, a first heat treatment is carried out, preferably in the presence of a reducing agent, before the treatment with a peroxide to be decomposed. This is done by straightforward heating to temperatures preferably of from 80° to 130° C. The heating time may vary within wide limits and is generally from 2 to 30 seconds.

The material according to the present invention is then treated with a peroxide compound in known manner. The simplest way of doing this is to bring the exposed layer into contact with vapours of a peroxide compound in the presence of heat. The most suitable peroxide compounds for this purpose are hydrogen peroxide or compounds which give off hydrogen peroxide when heated, for example percabamide and the materials described in German Offenlegungsschrift No. 2,420,521. One such process is known from German Offenlegungsschrift No. 2,418,997.

In one preferred embodiment, the exposed layer is brought into contact with a sheet-form material containing hydrogen peroxide or addition products thereof. The layer and the material are then heated in contact, hydrogen peroxide being transferred from the support layer to the exposed silver salt dispersion layer. A vesicular image or, if the silver salt dispersion layer contains reaction components for a dye-producing oxidation reaction, a visible dye image is formed in the silver salt dispersion layer.

The two possibilities of producing visible images by the image-wise decomposition of peroxide compounds are described in U.S. Pat. Nos. 3,615,491 and the preferred embodiment discussed above are described in U.S. Pat. No. 3,765,890.

EXAMPLE 1

Comparison Material (Prior Art)

A mixture of 250 ml of a 10% aqueous solution of inert gelatin and 50 ml of a 2% aqueous solution of silver nitrate are initially introduced and 10 ml of a 5% aqueous solution of potassium bromide added dropwise thereto. The emulsion is solidified in the conventional way. It has a $P_{Ag}$-value of 3.75. The silver bromide grains have an average grain diameter of 0.015 μm.

Before casting, 2.5 ml of a 30% aqueous saponin solution and 15 ml of a 10% aqueous solution of 1-phenyl-3-pyrazolidone are added, followed by adjustment using borax to a pH of from 5.7 to 5.8.

The emulsion is applied to a layer support of cellulose triacetate with a silver concentration (in the form of silver halide) of 0.3 g per square meter. After drying at 28° C., the photographic material has a transparency of 90%. It is exposed and then heated to 100° C. for about 5 seconds in a heating press. The thus-treated film is then heated in close contact with an $H_2O_2$-containing film to a temperature of approximately 100° C., by means of a heating press.

The film is obtained by coating a cellulose acetate film with a solution of polyvinyl alcohol or carboxymethyl cellulose containing added hydrogen peroxide. The film contains 2 to 6 g of $H_2O_2$ per square meter. The sensitometric values obtained are shown in Table 1.

EXAMPLE 2 (Invention)

The following solutions are prepared:

| | |
|---|---|
| Solution 1: | |
| $H_2O$ | 500 ml |
| gelatin | 0.5 g |
| polymer 1 | 2.5 g |
| pH | 4.0 |
| Solution 2: | |
| $H_2O$ | 200 ml |
| $AgNO_3$ | 2.1 g |
| Solution 3: | |
| $H_2O$ | 200 ml |
| $NaHPO_4$ | 0.75 g |
| Solution 4: | |
| $H_2O$ | 200 ml |
| KBr | 1.5 g |
| KI | 0.001 g |
| Solution 5: (allow to swell) | |
| $H_2O$ | 100 ml |
| gelatin | 100 g |

"Polymer 1" is polymer No. 4 described on page 8 of German Offenlegungsschrift No. 2,508,279. The same polymer is referred to as "polymer 4" in U.S. Pat. No. 4,152,161, columns 4–5.

2 Minutes before the beginning of precipitation, the metal salts indicated in Table 1 are introduced into the solution. Solutions 2 to 4 are then rapidly poured into solution 1 in that order. After the addition of 4.4 mg of $HAuCl_4$ and 110 mg of $NH_4SCN$, the emulsion is digested for 30 minutes at 40° C. Solution 5 is then added, solidified and the emulsion cast onto a layer support and further processed in the same way as described in Example 1.

TABLE 1

| Example No. | Sample | Salt added | Quantity (0.01 per aqueous solution) | Rel. speed |
|---|---|---|---|---|
| 1 | 1 | | | 100 |
| 2 | 1 | $CoSO_4 \times 7\ H_2O$ | 1 ml | 1800 |
| 2 | 2 | $CoSO_4 \times 7\ H_2O$ | 10 ml | 1800 |
| 2 | 3 | $CoCl_2 \times 6\ H_2O$ | 1 ml | 1600 |
| 2 | 4 | $CuSO_4 \times 5\ H_2O$ | 1 ml | 1850 |
| 2 | 5 | $CuSO_4 \times 5\ H_2O$ plus 2 ml of $Na_2SO_3$-solution (1%) | 0.2 ml | 1800 |
| 2 | 6 | $Ce\ (SO_4)_2$ | 1 ml | 1600 |
| 2 | 7 | $CoSO_4 \times 3\ H_2O$ and $CuSO_4 \times 5\ H_2O$ | 1 ml<br>1 ml | 1800 |

A two-fold increase in the relative speed value corresponds to a two-fold increase in speed.

EXAMPLE 3

The following solutions are prepared:

| | |
|---|---|
| Solution 1: | |
| $H_2O$ | 500 ml |
| gelatin | 0.5 g |
| polymer 1 | 2.5 g |
| pH | 4.0 |
| Solution 2: | |
| $H_2O$ | 100 ml |
| $Co(NO_3)_2$ | 0.2 g |
| Solution 3: | |
| $H_2O$ | 200 ml |
| $Na_2HPO_4$ | 0.75 g |
| Solution 4: | |
| $H_2O$ | 200 ml |
| $AgNO_3$ | 2.1 g |
| Solution 5: | |
| $H_2O$ | 200 ml |
| KBr | 1.5 g |
| KI | 0.001 g |
| Solution 6: (allow to swell) | |
| $H_2O$ | 100 ml |
| gelatin | 100 g |

Solutions 2 and 3 are added to solution 1 with vigorous stirring. $Co_3(PO_4)_2$ is precipitated in fine distribution. The precipitate is allowed to grow for 1 minute at 40° C. Solution 4 is then added and $Co_3(PO_4)_2$ is converted to $Ag_3PO_4$. $Ag_3PO_4$ is then converted by the halide present in solution 5. The emulsion is then digested for 30 minutes with 4.4 mg of $HAuCl_4$ and 110 mg of $NH_4SCN$, solution 6 is added and the emulsion solidified. The final pH is 6.2. The emulsion is further processed, exposed and developed in the same way as described in Example 1. Compared with the material of Example 1, the material obtained shows an increase in speed by a factor of 9.

What is claimed is:

1. A photosensitive material for the production of vesicles in imagewise distribution containing at least one silver halide emulsion layer comprising as silver halide essentially silver bromide and having a silver content (expressed as silver nitrate) of 1 to 800 mg, and optionally further layers, wherein the silver halide grains of the silver halide emulsion have an average grain size of utmost 0.1 μm and wherein the grains of the emulsion have been precipitated in the presence of at least one $Co^{2+}$, $Ce^{3+}$, $Ce^{4+}$, $Cu^{+}$, or $Cu^{2+}$ salt said salt being in a quantity of from $10^{-1}$ to $10^{-8}$ moles per mole of silver halide.

2. A photosensitive material as claimed in claim 1, wherein the silver halide emulsion is obtained at least partly by converting a silver phosphate with a water-soluble halide.

3. A photosensitive material as claimed in claim 1, wherein the emulsion is prepared in the presence of a polymer containing 8-oxyquinoline units.

4. A material as claimed in claim 1, wherein the transparency of the material amounts to at least 80%.

5. A process for the preparation of photographic images comprising the steps of imagewise exposure of a silver halide emulsion layer comprising as silver halide essentially silver bromide and having a silver content (expressed as silver nitrate) of 1 to 800 mg wherein the silver halide grains of the silver halide emulsion have an average grain size of at the utmost 0.1 mm and wherein the grains of the emulsion have been precipitated; in the presence of at least one $Co^{2+}$, $Ce^{3+}$, $Ce^{4+}$, $Cu^{+}$ or $Cu^{2+}$ salt, said salt being in a quantity of from $10^{-1}$ to $10^{-8}$ moles per mole of silver halide, and after said exposure treating the material with a peroxide compound and the treatment to make the image visible.

6. A process as claimed in claim 5, wherein between exposure and the treatment with a peroxide compound, the material is subjected to a heat treatment.

7. A process as claimed in claim 5, wherein the peroxide compound is hydrogen peroxide.

8. A process as claimed in claim 5, wherein the image is made visible by vesicle formation.

9. A process as claimed in claim 5, wherein the image is made visible by a dye-produced reaction.

* * * * *